United States Patent [19]

Bodin

[11] 4,280,781

[45] Jul. 28, 1981

[54] FORK-LIFT TRUCK HAVING MEANS FOR REGULATING THE HORIZONTAL DISTANCE BETWEEN THE TINES AND FOR LATERALLY DISPLACING THE TINES

[76] Inventor: Ove Bodin, Box 54, 710 10 Fjugesta, Sweden

[21] Appl. No.: 31,330

[22] Filed: Apr. 18, 1979

[30] Foreign Application Priority Data

Apr. 25, 1978 [SE] Sweden ..... 7804716

[51] Int. Cl.[3] ..... B66B 9/20; B66F 9/00

[52] U.S. Cl. ..... 414/671; 414/785

[58] Field of Search ..... 414/785, 670, 671

[56] References Cited

U.S. PATENT DOCUMENTS

| | | | |
|---|---|---|---|
| 2,451,943 | 10/1948 | Gunning | 414/671 |
| 2,483,745 | 10/1949 | Vossenberg | 414/671 |
| 2,958,436 | 11/1960 | Skutle et al. | 414/785 |
| 3,289,873 | 12/1966 | Hansen | 414/671 |
| 3,356,241 | 12/1967 | Vavilek | 414/671 |

*Primary Examiner*—Leslie J. Paperner
*Assistant Examiner*—L. E. Williams
*Attorney, Agent, or Firm*—Burns, Doane, Swecker & Mathis

[57] ABSTRACT

A truck of the kind provided with tines by which goods can be lifted and conveyed is provided, in which the tines are arranged to co-act with apparatus for regulating the horizontal distance therebetween. The apparatus comprises a screw-threaded spindle with which sleeves mounted on the tines co-act. Rotation of the spindle causes the tines to move towards or away from each other. The spindle is provided at its center or in the neighborhood thereof with right-hand and left-hand screw threads. The sleeve of one tine has a corresponding right-hand screw thread and the sleeve of the other tine has a corresponding left-hand screw thread. The spindle is arranged to co-operate with a shaft. Between the shaft and the spindle apparatus is arranged which causes the spindle to rotate in a direction corresponding to the direction of rotation of the shaft, and which permits lateral displacement (axial displacement) of the spindle relative to the shaft. The spindle is mounted, via the shaft, to an upper part of a frame structure, the upper part also carrying apparatus for driving the shaft and the spindle.

10 Claims, 5 Drawing Figures

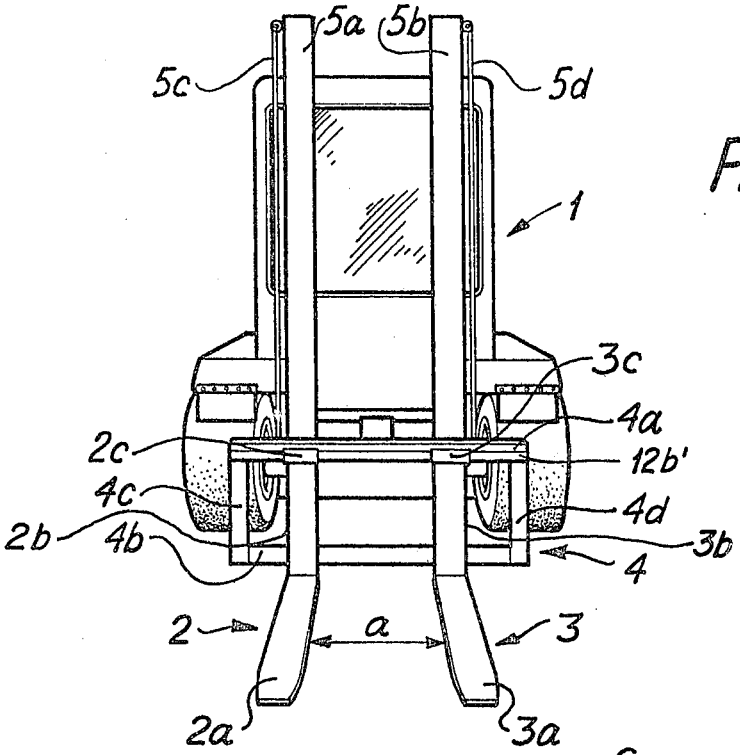
Fig. 1
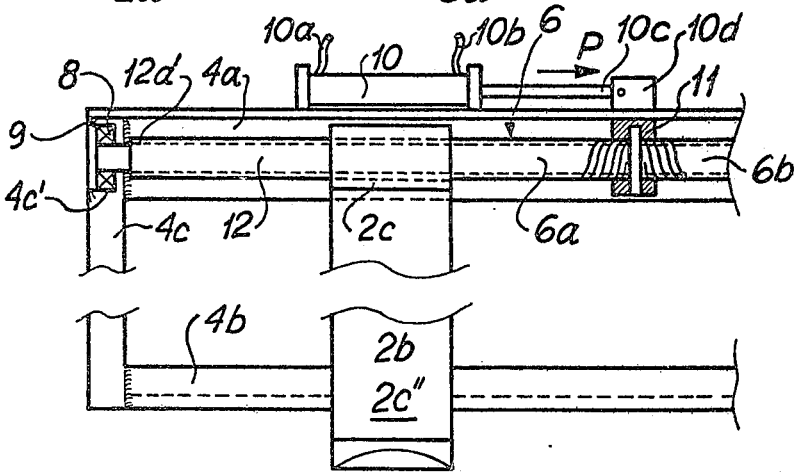
Fig. 2
Fig. 3
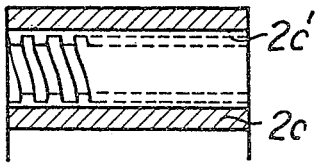
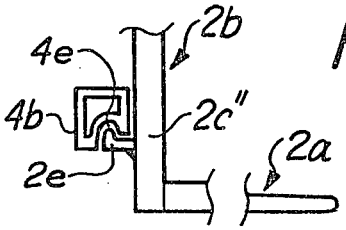
Fig. 4

FORK-LIFT TRUCK HAVING MEANS FOR REGULATING THE HORIZONTAL DISTANCE BETWEEN THE TINES AND FOR LATERALLY DISPLACING THE TINES

FIELD OF THE PRESENT INVENTION

The present invention relates to a truck and in particular, although not exclusively, to trucks of the kind designated fork-lift trucks, i.e., trucks which carry normally two tines by which goods can be lifted and carried.

BACKGROUND OF THE PRESENT INVENTION

In such trucks the tines co-operate with apparatus such that the horizontal distance between the tines can be regulated to a suitable position under prevailing circumstances, and such that the tines can be moved laterally to an arbitrarily fixed distance therebetween.

Trucks provided with apparatus for regulating the horizontal distance between the tines are known to the art. Such trucks normally having two serially connected hydraulic cylinders with associated pistons, in which the piston rod of one piston acts on one tine and the piston rod of the other piston acts on the other tine.

It has been found that these hydraulic cylinders must normally be mounted on a homogeneous rectangular plate, having a height which corresponds approximately to the vertical part of the tine arrangement and a width which normally corresponds to the maximum width between the tines. The homogeneous rectangular plate is also provided with guides for the tines. The hydraulic cylinders and associated pistons are normally placed between guides, which means that the elements necessary for regulating the horizontal distance between the tines cover the major portion of the surface of the plate.

The use of the previously known apparatus has created a number of disadvantages, one of which being that the homogeneous plate is liable to obstruct the field of view of the driver when the horizontal leg of the tine arrangement is to be inserted beneath a pallet, a box or like object. This is particularly difficult when the tines are located at a height of 0.5–2.0 meters.

Thus, the homogeneous plate and the parts attached thereto create a difficult obstacle for the driver. In order to overcome the obscuring effect which the plate has on the driver, it is often necessary for the driver to lean far beyond the side of the truck, in order to be able to see well enough to position the tines correctly.

A disadvantage with two hydraulic cylinders, where one cylinder is intended for a respective tine, is that the cylinders must normally be coupled in series, which means that there is no guarantee that an initiated displacement of the tines will result in respective tines being displaced laterally to one and the same extent relative to a central vertical plane allotted to the truck for the purpose of deciding said lateral displacement. For example, it is not unusual for one tine to move more readily than the other and hence reach its terminal position of displacement before the other tine, which may be sluggish, has begun to move. Because of the homogeneous plate, it is practically impossible for the driver to determine the distance between the tines. When a load is lifted with only one tine in its terminal position of displacement the truck will be unevenly loaded which may result in serious problems.

OBJECTS OF THE PRESENT INVENTION

Constructions have been proposed which eliminate the aforementioned disadvantages. These proposals in structural modifications enable the driver to effectively supervise adjustment of the tines and the vertical position thereof from the driver's seat. Additionally, these modifications ensure that the tines are each displaced through an equal distance relative to the central vertical plane allotted to the truck. In trucks of the aforementioned kind provided with tines by which goods can be lifted and transported by the truck and in which the tines co-operate with apparatus for regulating the horizontal distance therebetween, the apparatus has the form of a threaded spindle with which sleeves mounted on the tines are arranged to co-act. When rotating the spindle in a clockwise or counter clockwise direction the tines are caused to move towards or away from each other, owing to the fact that the spindle is provided with a corresponding right-hand thread and left-hand thread at the center portion of the spindle or in the neighborhood thereof, and out towards respective end parts thereof. The sleeve of one tine has a corresponding right-hand thread and the sleeve of the other tine has a corresponding left-hand thread.

In addition to being able to regulate the horizontal distance between the tines, it is also important with fork-lift trucks of the kind mentioned that the tines can be laterally displaced while adjusting the tines to a regulated horizontal distance therebetween. If the truck is obliquely positioned relative to the load the tines can readily be displaced laterally, thereby obviating the need to move the truck itself to a more exact position.

BRIEF DESCRIPTION OF THE DRAWINGS

So that the invention will be more readily understood and further features thereof made apparent, an exemplary embodiment of the invention will now be described with reference to the accompanying schematic drawings, in which, FIG. 1 is a front view of a truck of the type exhibiting tines by which goods can be lifted and conveyed, and in which the tines are arranged to co-operate with apparatus constructed in accordance with the invention to enable the horizontal distance between the tines to be regulated and also to enable lateral displacement of said tines, FIG. 2 is an enlarged view of the left-hand part of the arrangement and frame construction applied to the truck shown in FIG. 1, FIG. 3 is a sectional view of a sleeve mounted to the upper section of the vertical part of the tine, FIG. 4 is a side view of the vertical lower part of the tine, said lower part slidingly co-operating with a lower part of the frame structure.

DESCRIPTION OF A PREFERRED EMBODIMENT

Figure 5:
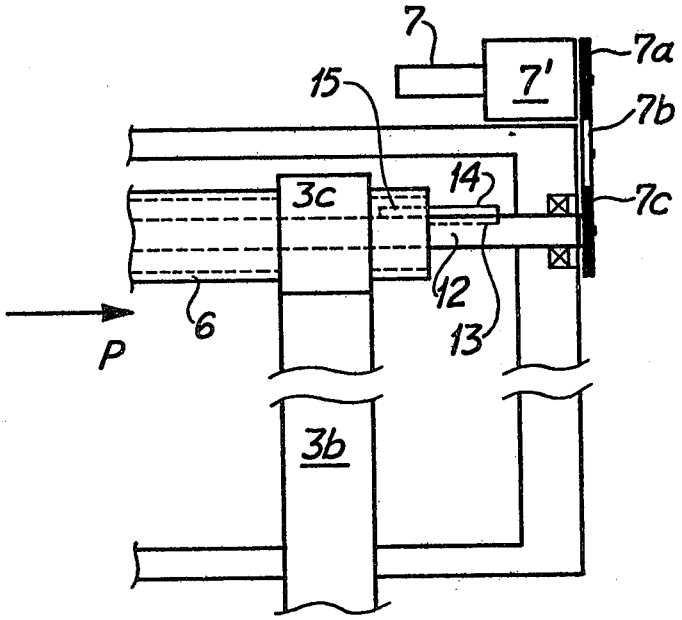
FIG. 5 is an enlarged view of the right-hand part of the arrangement shown in FIG. 1.

FIG. 1 shows in front view a truck 1 of the kind having tines 2, 3 by which goods (not shown in FIG. 1) can be lifted and transported. The tines 2 and 3 co-act with apparatus for regulating the distance therebetween, when said tines are located in a position which is disoriented with regard to the load which they are to lift. In FIG. 1 the horizontal distance between the tines has been designated "a".

As will be seen from FIG. 1, the tines 2 and 3 are identical with the exception of a small difference, as hereinafter described. For reasons of simplicity, only tine 2 will be described hereinafter. It will be seen, however, that the two tines are of angular configuration having a horizontal, load carrying part or leg 2*a*, 3*a* and a vertical part or leg 2*b*, 3*b*. The upper portion of the vertical part 2*b* exhibits a sleeve 2*c* while the upper portion of the vertical part 3*b* exhibits a sleeve 3*c*.

A frame structure 4 comprises two parallel horizontal portions 4*a* and 4*b* respectively and two parallel vertical portions 4*c* and 4*d* respectively.

The frame structure 4 is vertically displaceable along guides 5*a* and 5*b*, by means of a chain 5*c* and a chain 5*d*. The tines 2 and 3 co-act with the frame structure 4 in a manner hereinafter made apparent.

Since the drive means for raising the frame structure 4, the drive means for moving the truck, the guide means and the necessary hydraulic system do not comprise part of the present invention, these will not be described in detail. It will be mentioned, however, that the truck includes a guide system arranged to pressurize hydraulic oil which is caused to pass through valves not shown, to a hydraulic motor which will be described with reference to FIG. 5, and a hydraulic system which will be described with reference to FIG. 2.

As shown in FIG. 2, the means whereby the horizontal distance between the tines can be adjusted comprises a screw-threaded spindle 6. Sleeve 2*c* and 3*c* mounted on respective tines 2 and 3 are arranged to co-operate with said spindle in a manner such that rotation of the spindle 6 causes the tines 2 and 3 to move towards and away from each other respectively, i.e. causes the distance "a" between the tines to decrease or increase respectively. The spindle 6 is provided at its center or in the neighborhood thereof with a right-hand thread and a left-hand thread. It is assumed that the portion 6*a* of the spindle has a right-hand thread and the portion 6*b* a left-hand thread. Thus, the sleeve 2*c* of one tine will have a corresponding right-hand thread and the sleeve 3*c* of the other tine 3 will have a corresponding left-hand thread.

The spindle 6 co-operates with a shaft 12 journalled in bearings on the upper portion 4*a* of the frame structure. The upper part 4*a* has the form of an angle-iron, and carries the drive means 7 for the shaft and spindle 6, said drive means having the form of a hydraulic motor. The angle-iron also carries a hydraulic cylinder 10 having hydraulic hoses 10*a* and 10*b* and a hydraulic piston with associated postion rod 10*c*. The free end of the piston rod co-operates with a support 10*d* the center part of which is arranged to rotably co-act with a flange 11 attached to the center part of the spindle 6. The spindle 6 is arranged to be moved forwards and backwards along the shaft 12 by displacement of the piston rod 10*c*. FIG. 2 showns the spindle in one of its terminal positions (its left terminal position). The spindle 6, which is driven by the drive means 7 via the shaft 12, is axially slidably mounted on the shaft 12, which in turn is rotatably mounted at its end parts 12*a*', 12*b*'. Conveniently, the bearings in which the ends of the shaft are journalled may be incorporated in the vertical parts 4*c*, 4*d* of the frames structure, preferably in those parts which are covered by the upper portion 4*a*. The bearings comprise a bearing 8 mounted in a recess 4*c*' in the part 4*c*. The bearing 8 cooperates with a central trunnion of the shaft 12 and is held in position by a circlip 9.

As will be seen from FIG. 3 the sleeve 2*c* of the tine 2 comprises a tube having a metal bush 2*c*' which has an internal screw thread corresponding to the screw thread 6*a* of the spindle 6. The spindle is conveniently provided with a trapezoid thread.

The metal bush 2*c*' is conveniently made of a suitable bearing metal, such as brass or bronze, in order to obtain good co-operation with the screw thread formed on the part 6*a* of the spindle.

The lower vertical part 2*c*'' of the tine 2 co-operates slidably with the lower part 4*b* of the frame structure. The lower part 4*b* of the frame structure has the form of a rectangular hollow beam provided with a longitudinally extending groove or recess arranged to co-operate with a hook fixedly attached to the tine. In FIG. 4 this hook is referenced 2*e*. FIG. 4 illustrates the hook slidably co-operating with the groove or recess 4*e* formed in the part 4*b*.

In the FIG. 2 embodiment it is assumed that the shaft 12 and the spindle 6 are driven by a drive means which may be the means 7 shown in FIG. 5, in which embodiment said drive means comprises a hydraulic motor governed by a transmission. In the illustrated embodiment the transmission is such that two complete turns of the hydraulic motor correspond approximately to one complete turn of the spindle. By selecting a hydraulic motor in which the oil consumption is 50 ccm per revolution the energy consumption required to displace the tines can be kept very low.

Since the valves of the hydraulic motor 7 and the means for generating the hydraulic oil are well known to those of normal skill in the art and do not form any part of the present invention, said valves and said means have not been shown in the drawings.

The other (right-hand) part of the apparatus shown in FIG. 1 is illustrated in FIG. 5, from which it can be seen that the hydraulic motor 7 is provided with a gear 7' and carries a gear wheel 7*a* which, through an intermediate gear wheel 7*b*, drives a gear wheel 7*c* mounted on the shaft 12. The shaft 12 is provided with an axially oriented groove or key way 13 in which there is arranged a key 14. The spindle 6 is provided with a groove or key way 15 whose cross sectional shape corresponds to half the cross sectional shape of the key 14. As a result of this arrangement, the spindle 6 will accompany the rotary movement of the shaft 12 while, at the same time, the spindle 6 can be moved axially along the shaft 12, thereby laterally displacing the tines 2 and 3 in the direction of the arrow "P" irrespective of their mutual distance.

The direction of the arrow "P" is shown to the right, because the spindle 6 is illustrated in its left-hand terminal position, although, as will be understood, this displacement can be made arbitrarily between the terminal positions.

The invention is not restricted to the described and illustrated embodiment, but can be modified within the scope of the following claims.

What is claimed is:

1. A fork lift truck having tines by which goods can be lifted and conveyed, comprising:

a frame member;

a key member;

a shaft member, said shaft member being rotatably mounted in a substantially horizontal direction on said frame member, and having key way means for accommodating said key member;

a spindle member, said spindle member being mounted on said shaft member and having:

key way means for accommodating said key member such that said spindle member is axially slidable on said shaft member and rotatable with said shaft member;

a first region having a right hand thread;

a second region having a left hand thread; and a third region substantially centrally located on said spindle member and including at least a part of said first region and at least a part of said second region;

a first tine member, said first tine member being supported by said frame member and having a first sleeve member, said first sleeve member having a right hand thread and being threadedly mounted on said first region of said spindle member;

a second tine member, said second tine member being supported by said frame member and having a second sleeve member, said second sleeve member having a left hand thread and being threadedly mounted on said second region of said spindle member;

first drive means connected to said shaft member for rotatively driving said spindle member in order to selectively rotate said first and second regions of said spindle member so that said first and second tine members are selectively driven toward and away from each other;

second drive means connected to said third region of said spindle member for laterally moving said first and second regions of said spindle member relative to said shaft member so that said first and second tine members are laterally displaced;

whereby when said shaft member is rotatively driven by said first drive means, said shaft member rotates, said key member accommodated therein urging said spindle member mounted thereon to rotate in unison with said shaft member thereby selectively driving said first and second tine members toward and away from each other; and further whereby when said spindle member is laterally driven by said second drive means, said key way means included on said spindle member is guided in said lateral movement by said key member accommodated in said key way means included on said shaft member.

2. The truck according to claim 1 wherein said frame member includes an upper frame member, said spindle member and said second drive means being mounted on said upper frame member.

3. The truck according to claim 1:

wherein said frame member includes first and second vertical frame members;

wherein said shaft member includes first and second end parts; and further wherein said shaft member is journalled at said first and second end parts onto said first and second vertical frame members.

4. The truck according to claim 1:

wherein said first sleeve member includes a first metal bush having an internal thread, said internal thread being said right hand thread; and further wherein said second sleeve member includes a second metal bush having an internal thread, said internal thread being said left hand thread.

5. The truck according to claim 1:

wherein said frame member includes a lower frame member;

wherein said first tine member includes a first lower vertical part and said second tine member includes a second lower vertical part; and further wherein said first and second lower vertical parts slidingly cooperate with said lower frame member.

6. The truck according to claim 5:

wherein said first lower vertical part includes a first hook member and said second lower vertical part includes a second hook member; and wherein said lower frame member includes a groove, said groove slidingly accommodating said first and second hook members.

7. The truck according to claim 1:

wherein said key way means included in said shaft member includes a substantially axially extending groove; and wherein said key way means included in said spindle member includes a substantially axially extending groove substantially equal to half the cross-section of said key member.

8. The truck according to claim 1 wherein said second drive means includes a hydraulic cylinder having a piston and a piston rod, said piston rod being connected to said third region of said spindle member.

9. The truck according to claim 8 further comprising:

a flange member included on said spindle member in said third region; and a support member accommodating said flange member such that said flange member is rotatable therein, wherein said piston rod is connected to said support member, whereby lateral movement of said piston rod imparts lateral movement to said spindle member.

10. A fork lift truck having tines by which goods can be lifted and conveyed, comprising:

a frame member;

a key member;

a shaft member journalled onto said frame member, said shaft member having a first longitudinal length and having key way means for mounting said key member;

a spindle member having a second longitudinal length smaller in magnitude than said first longitudinal length, said spindle member being mounted on said shaft member such that said spindle member is longitudinally slidable relative to said shaft member and rotatable in unison with said shaft member, said spindle member having:

key way means for slidingly accommodating said key member;

a right hand thread region; and a left hand thread region;

a first tine member slidingly supported by said frame member and having an internal thread threadedly engaged by said right hand thread region such that when said spindle member rotates in a first direction of rotation said tine member slides across said frame member in a first lateral direction and when said spindle member rotates in a second direction of rotation said tine member slides across said frame member in a second lateral direction opposite to said first lateral direction;

a second tine member slidingly supported by said frame member and having an internal thread threadedly engaged by said left hand thread region such that when said spindle member rotates in said first direction of rotation said tine member slides across said frame member in said second lateral direction and when said spindle member rotates in the second direction of rotation said tine member slides across said frame member in said first lateral direction;

first drive means connected to said shaft member for selectively driving said spindle member in said first and second directions of rotation; and second drive means connected to said spindle member for laterally moving said spindle member relative to said shaft member such that said tines are laterally displaced in unison relative to said shaft member.

* * * * *